United States Patent [19]

Dingler

[11] Patent Number: 4,529,163

[45] Date of Patent: Jul. 16, 1985

[54] COMBINATION OF FORM PANELS AND FORM LOCK DEVICES

[76] Inventor: Gerhard Dingler, Industriestr. 20, 7274 Haiterbach, Fed. Rep. of Germany

[21] Appl. No.: 602,546

[22] Filed: Apr. 20, 1984

[51] Int. Cl.[3] ..... E04G 9/06

[52] U.S. Cl. ..... 249/192; 249/219 R

[58] Field of Search ..... 249/47, 192, 219 R; 425/432

[56] References Cited

U.S. PATENT DOCUMENTS

| | | | |
|---|---|---|---|
| 1,593,610 | 7/1926 | White | 249/219 R X |
| 2,151,210 | 3/1939 | Jennings | 249/192 X |
| 2,732,605 | 1/1956 | Johnson | 425/432 |
| 2,882,583 | 4/1959 | Arrighini et al. | 249/192 X |
| 3,550,848 | 12/1970 | Ursini | 249/47 X |
| 3,601,356 | 8/1971 | Yurick | 249/192 |

FOREIGN PATENT DOCUMENTS

| | | |
|---|---|---|
| 322186 | of 1975 | Austria . |
| 2049245 | of 1972 | Fed. Rep. of Germany . |
| 1334155 | of 1973 | United Kingdom . |

*Primary Examiner*—J. Howard Flint, Jr.

[57] ABSTRACT

The invention relates to a combination of two factory-built forms consisting of two form panels set within sectional steel frames having longitudinal channels with flanks forming an acute angle to each other and having outer flanges and ribs; in the locked and tightened state the ribs are in contact with each other; the combination also consists of a form lock device which forces the steel frames tightly against each other and brings the outer flanges into alignment.

3 Claims, 5 Drawing Figures

Fig. 4
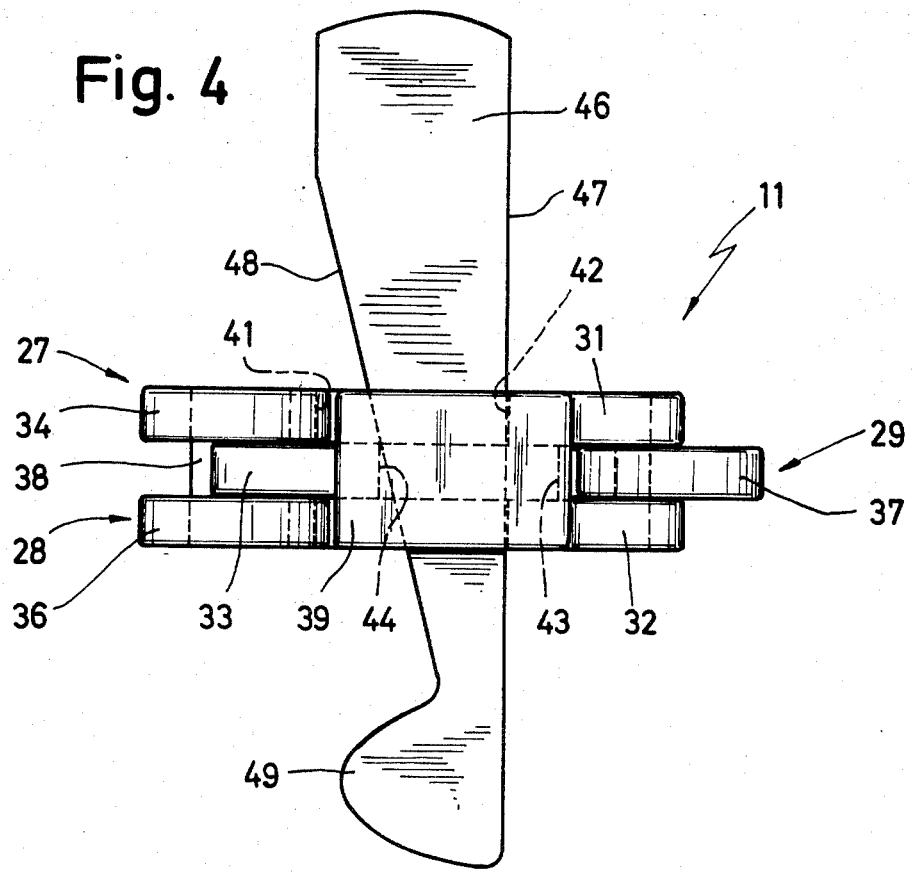
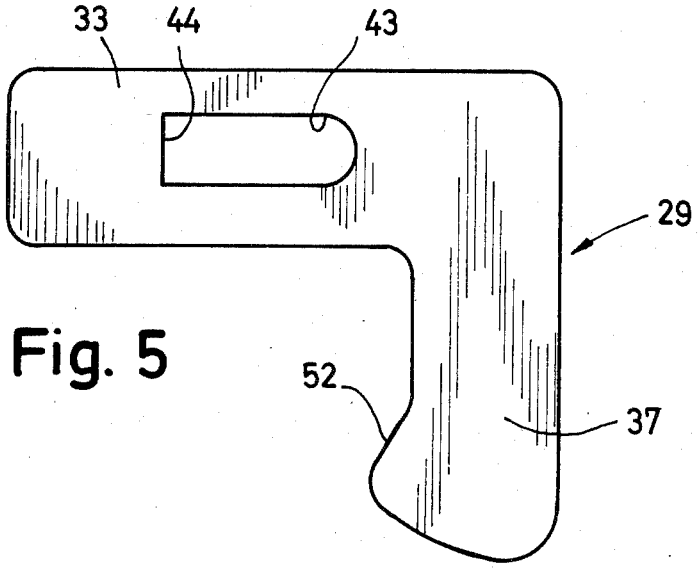
Fig. 5

COMBINATION OF FORM PANELS AND FORM LOCK DEVICES

The invention relates to a combination of two factory-built forms consisting of two form panels set within sectional steel frames having longitudinal channels with flanks forming an acute angle to each other and having outer flanges and ribs; in the locked and tightened state the ribs are in contact with each other; the combination also consists of a form lock device which forces the steel frames tightly against each other and brings the outer flanges into alignment.

BACKGROUND OF THE INVENTION

Such a combination is shown in Austrian Pat. No. 322 186. However, this patent does not describe a device which would also bring the outer flanges of the frames into alignment. However, such a device is shown in German Offenlegungsschrift (printed publication of an unexamined patent) No. 20 49 245. But in the device shown there the ribs do not come into contact with each other either when the steel frames are in the locked or unlocked state.

The combination described in the Austrian patent has the following disadvantages:

(a) The form panels are not aligned until the combination is set in place. Alignment is achieved by driving in a wedge. The resulting forces act to compress a plastic spacer sleever. However, the latter sleeves are usually made of plastic and do not stand up up to such forces. This means that one must try beforehand to align the form panels.

(b) The number of tie bolts used to join two form panels together depends on the number of aligned transverse holes provided in the steel frames. However, if a large number of holes are provided this weakens the frames. The tie bolts cannot perform any alignment because they cannot exert any force in a direction perpendicular to the plane of the form panels.

(c) It is not possible to produce a combination of forms in which the form panels can be offset in height in relation to each other by any desired amount.

(d) Combinations of form panels often consist of an entire unit pre-assembled on the ground which has to be lifted into the correct position by a crane. Because of the hitherto available form lock devices such a combination is very unstable and has to be handled carefully. When the combination of forms is then placed against the wall to be poured, it has to be adjusted, i.e. the form panels have to be aligned.

(e) If the sectional steel frame of the form is hollow, the holes in its flanks have to be plugged to prevent any concrete flowing in. These are all additional work steps.

(f) The holes in the flanks dictate at what points the forms can be locked, although these points may not always be the optimum ones at which to position the locks.

(g) In the known type of combination of forms, the initially established flush alignment may be lost when the tie rods, which are always present, are tightened.

(h) The combination of forms is difficult to produce because the wedges are hard to reach to knock them in. If one is not careful, it is possible to hit the sectional steel frame because the wedges are located close to the frame, and what is more they are located at those parts of the frame which form a corner with the form panel. In practice, therefore, the lock elements are positioned in such a way that the wedges run at an angle from top front to bottom rear. This means, however, that when the wedges are removed again there is practically no room for the hammer to be used, because the tip of the wedge is even more inaccessible than the head.

OBJECTS AND STATEMENT OF THE INVENTION

It is the object of the invention to provide a combination of forms which avoids the above-mentioned disadvantages and which can be locked together simply, at any desired spot, without weakening the frames; such a combination does not pose any problems in positioning or removing the locking wedges; the design permits the form panels to be positioned at any desired heights relative to each other; and once the form panels have been aligned, this alignment is permanently retained and no further adjustments are necessary.

In the design according to the invention, these problems are solved by the following means:

(a) The form lock device consists of two essentially congruent, approximately L-shaped, torsionally rigid claws, spaced a certain distance apart, arranged parallel to each other and rigidly joined together.

(b) On the side facing the outer flanges of the sectional steel frames, the transverse webs of the L-shaped claws are provided with a contact surface which rests against the outer flanges of the steel frames.

(c) A third claw, which is essentially congruent with the first two claws, is located with its transverse web passing between the transverse webs of the first two claws.

(d) At their tips the longitudinal webs of the claws have angled surfaces on the sides facing each other; the angle at which these surfaces are arranged corresponds approximately to the angle at which the outer flanks of the longitudinal channels of the sectional steel frames are arranged; when a tighening wedge is driven into place, these claws are forced under pressure against the outer flanks of the longitudinal channels.

(e) The transverse webs of the first two claws have contact surfaces against which lies one contact side of the locking wedge, and the transverse web of the third claw also has a contact surface against which lies a second contact side of the locking wedge, so that the locking wedge is located between the two contact surfaces.

A preferred example of the design according to the invention will now be described.

DESCRIPTION OF THE DRAWINGS

The drawings show:

FIG. 4 A view of the form lock assembly, looking in the direction of arrow C in FIG. 1.

FIG. 5 Top view of the third claw in the form lock assembly.

DETAILED DESCRIPTION

Figure 1:
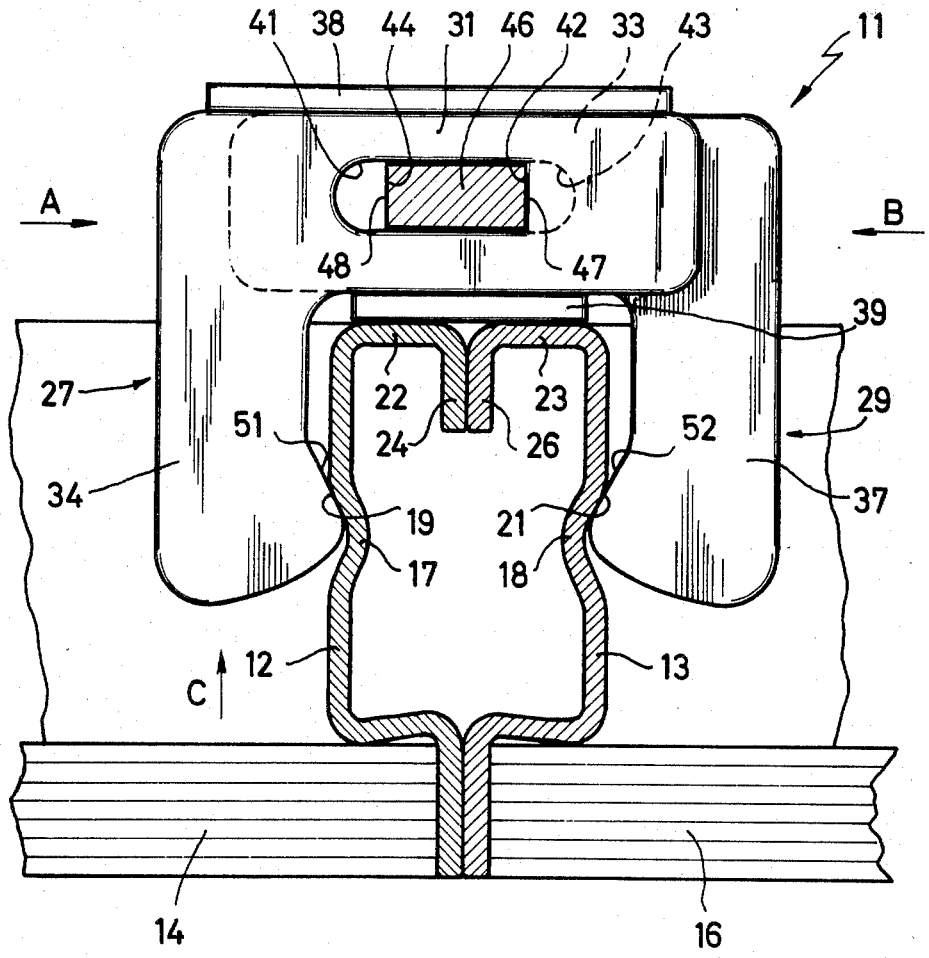
FIG. 1: Top view of the form lock assembly, scale 1:1, fitted to two sectional steel frames together with form panels.
Figure 2:
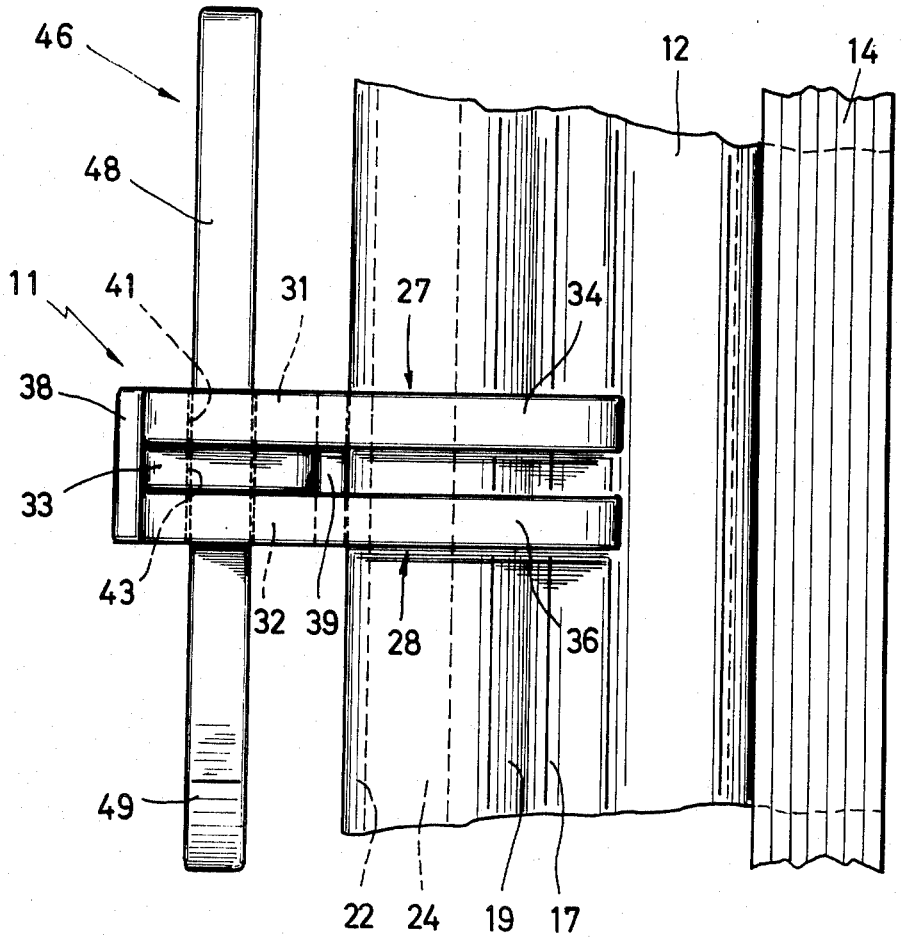
FIG. 2 A side view, looking in the direction of arrow A in FIG. 1.
Figure 3:
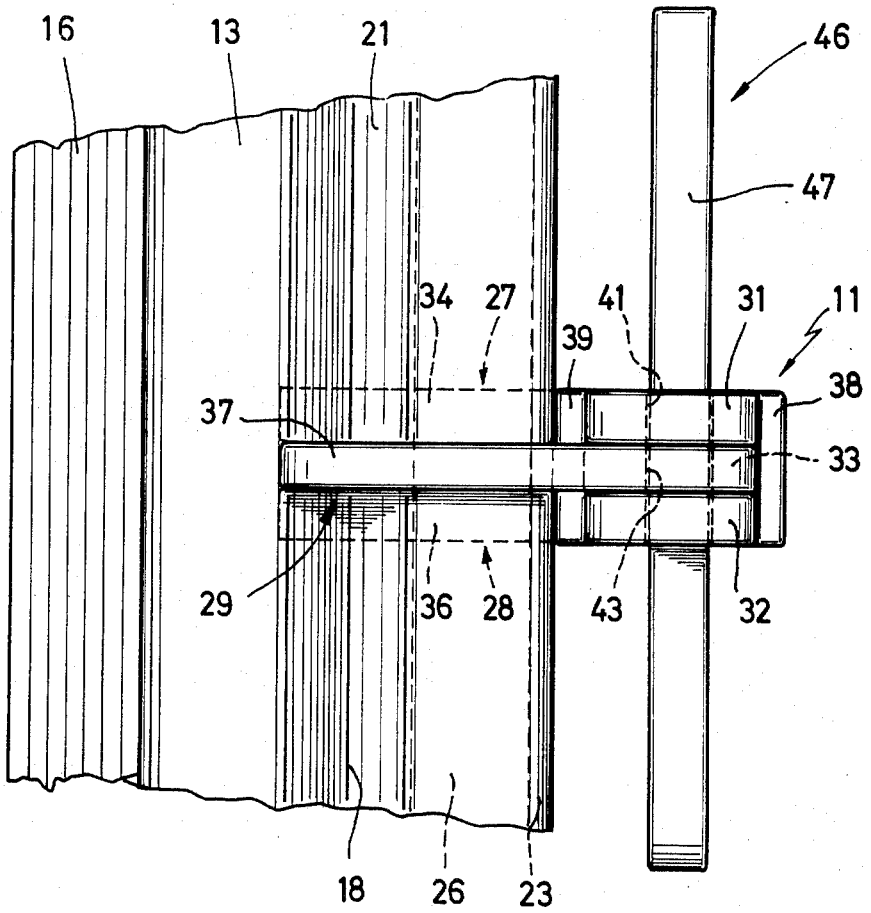
FIG. 3 The other side view, looking in the direction of arrow B in FIG. 1.

A form lock assembly is used in conjunction with sectional steel frames 12, 13 in which are set the form panels 14, 16. The steel frames 12, 13 are characterized by a longitudinal channel 17, 18 which has flanks 19, 21. As can be seen in the figures, flanks 19, 21 are arranged at an acute angle to each other and the form lock assembly engages against them. In addition, the sectional steel frames 12, 13 have outer flanges 22, 23. When the steel frames 12, 13 are locked together, the ribs 24, 26 are in contact with each other.

The lock assembly 11 consists essentially of a first claw 27, a second claw 28 and a third claw 29. The claws 27, 28, 29 are punched out of approx. 8 mm thick steel sheet and otherwise have the dimensions shown in the full-scale figures. Claws 27, 28 are congruent with each other as is evident in FIG. 1. Each of the claws 27, 28, 29 is approx. L-shaped and has a transverse web 31, 32, 33 and a longitudinal web 34, 36, 37. The transverse webs 31, 32 are rigidly joined externally by a bridge 38 and internally by bridge 39, and they are spaced such a distance apart that the transverse web 33 is movable back and forth with a little play between transverse webs 31, 32, while it has very little play in other directions. Bridges 38, 39 can be bolted together with the transverse webs 31, 32. However, they can also be formed as tabs which are integrally part of transverse web 31 or transverse web 32 or alternately of one of the transverse webs 31, 32 and are bent over by 90° from one transverse web to the other and are welded there.

Two congruent elongate openings 41 are provided in transverse webs 31, 32; as per FIG. 1 for ease of manufacture they have a rounded end on the left-hand side while the right-hand side always has a straight contact surface 47. An opening 43 is provided in transverse web 33; this opening is also elongate, although in this case the rounded end is on the right and the straight contact surface 44 is on the left.

A wedge 46 passes through openings 41, 43; this wedge has a head at the top for driving with a hammer, and on the left and right it is provided with contact surfaces 47, 48 as per FIG. 4; it is less thick than the height of the openings 41, 43 and at the bottom end it has a nose 49 which guarantees that the wedge 46 cannot be lost, because as can be seen in FIG. 4, the nose 49 projects far to the left.

The dimensions are selected in such a way that when the wedge 46 is fully inserted to give the maximum locking force, the distance between the contact surfaces 42, 44, as shown in FIG. 1, is smaller than the length of the openings 41, 43. Thus, when wedge 46 is driven in, the longitudinal webs 34, 36 move towards longitudinal web 37. The clearance between the claws 27, 28 on the one hand and claw 29 on the other becomes smaller.

Longitudinal webs 34, 36, 37 have inclined surfaces 51, 52 which make contact with the flanks 19, 21 and extend to the right or left beyond the inner contour of the longitudinal webs 34, 36, 37 so that at those points the longitudinal webs are not in contact with the sectional steel frames 12, 13 and only the inclined surfaces 51 and 52 make contact.

When the form lock 11 is placed in position and wedge 46 is gently driven in, the contact surfaces 47, 48, by virtue of the force which they exert on the flanks 19, 21, move the outer flanges 22, 23 towards the bride 39 and the frames 12, 13 and consequently also the form panels 14, 16 are brought into alignment. If wedge 46 is not driven in even further, the additional force is used to move the frames 12, 13 against each other with a great deal of force, which is exerted not only by the wedge effect of wedge 46 but also by the orientation of the flanks 19, 21 to the inclined surfaces 51, 52, because as more force is applied to wedge 46 the inclined surfaces 51, 52 slide deeper into the longitudinal channels 17, 18.

The travel of claw 29 relative to claws 27, 28 is such that the lock assembly 11 can be directly slipped onto the steel frames 12, 13 from the front, even when they are a few millimeters apart. The total travel of the claws is about 10 mm. The weight of the entire lock assembly is approx. 1 kg.

The embodiments of the invention in which an exclusive property or privilege is claimed are defined as follows:

1. In the combination of two factory-built forms comprising two form panels set within sectional steel frames having longitudinal channels with outer flanks forming an acute angle to each other, and having outer flanges and ribs; in the locked and tightened state the ribs are in contact with each other; the combination also comprises of a form lock device which forces the steel frames tightly against each other and brings the outer flanges into alignment; wherein the improvement in the combination comprises:

(a) The form lock device consists of two essentially congruent, approximately L-shaped, torsionally rigid claws spaced a distance apart, arranged parallel to each other and rigidly joined together, (b) On the side facing the outer flanges of the sectional steel frames, the L-shaped claws are provided with transverse webs with a contact surface which rests against the outer flanges of the steel frames, (c) A third claw, which is largely congruent with the first two claws, has a transverse web passing between the transverse webs of the first two claws, (d) The claws have longitudinal webs, which at their tips, have angled surfaces on the sides facing each other; the angle at which these surfaces are arranged corresponds approximately to the angle at which the outer flanks of the longitudinal channels of the sectional steel frames are arranged;

(e) A locking wedge is arranged, when driven into place, to force claws under pressure against the outer flanks of the longitudinal channels, and (f) The locking wedge has first and second contact sides and the transverse webs of the first two claws have a contact surface against which lies the first contact side of the locking wedge, and the transverse web of the third claw has a contact surface against which lies the second contact side of the locking wedge, so that the locking wedge is located between the two contact surfaces.

2. Combination according to claim 1, wherein the locking wedge is inserted perpendicular to the form lock device.

3. Combination according to claim 1, by wherein a bridge joins the first two claws, and has an outer side in contact with the outer flanges.

* * * * *